US009214732B2

(12) United States Patent
Huang et al.

(10) Patent No.: US 9,214,732 B2
(45) Date of Patent: Dec. 15, 2015

(54) FLEXIBLE PIFA ANTENNA WITH TUNABLE COUPLING ELEMENT

(71) Applicants: Chen Hung Huang, Zhongli (TW); Ronan Quinlan, Wexford (IE)

(72) Inventors: Chen Hung Huang, Zhongli (TW); Ronan Quinlan, Wexford (IE)

(73) Assignee: TAOGIAS GROUP HOLDINGS LIMITED, Wexford (IE)

( * ) Notice: Subject to any disclaimer, the term of this patent is extended or adjusted under 35 U.S.C. 154(b) by 172 days.

(21) Appl. No.: 14/091,182

(22) Filed: Nov. 26, 2013

(65) Prior Publication Data

US 2014/0218260 A1 Aug. 7, 2014

Related U.S. Application Data

(60) Provisional application No. 61/729,728, filed on Nov. 26, 2012.

(51) Int. Cl.

| | |
|---|---|
| ***H01Q 1/38*** | (2006.01) |
| ***H01Q 9/04*** | (2006.01) |
| *H01Q 9/42* | (2006.01) |

(52) U.S. Cl.
CPC ..... *H01Q 9/0421* (2013.01); *H01Q 9/42* (2013.01)

(58) Field of Classification Search
USPC ..... 343/700 MS, 861
See application file for complete search history.

(56) References Cited

U.S. PATENT DOCUMENTS

| | | | | |
|---|---|---|---|---|
| 6,765,539 | B1 * | 7/2004 | Wang et al. | 343/795 |
| 2005/0073465 | A1 * | 4/2005 | Olson | 343/795 |
| 2006/0145924 | A1 * | 7/2006 | Chen et al. | 343/700 MS |
| 2013/0229311 | A1 * | 9/2013 | Chi et al. | 343/700 MS |

* cited by examiner

*Primary Examiner* — Tan Ho
(74) *Attorney, Agent, or Firm* — Coastal Patent Law Group P.C.

(57) ABSTRACT

A modified PIFA antenna is designed for wireless local area network (WLAN) applications. The modified PIFA antenna is configured to resist detuning effects caused by use of various cable lengths and is adapted for use in the 2.4 GHz operation band. A slot extends between the ground and feed portions of the antenna for slightly increasing frequency bandwidth of the antenna.

6 Claims, 4 Drawing Sheets

FIG. 1A
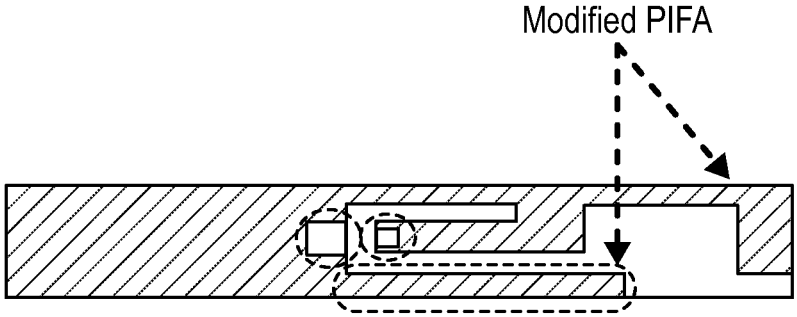
FIG. 1B
FIG. 1C
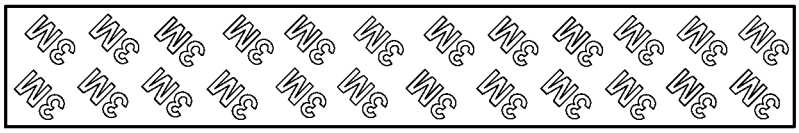

FLEXIBLE PIFA ANTENNA WITH TUNABLE COUPLING ELEMENT

CROSS-REFERENCE TO RELATED APPLICATIONS

This application claims benefit of priority with U.S. Provisional Ser. No. 61/729,728, filed Nov. 26, 2012; the contents of which are hereby incorporated by reference.

BACKGROUND OF THE INVENTION

1. Field of the Invention

This invention relates to wireless communications, and more particularly to antennas for use in such wireless communications.

2. Description of the Related Art

A wireless local area network (WLAN) provides a user with the ability to connect to a local area network (LAN) through a wireless radio connection. WLANs have become popular in the office and home networks due to ease of installation and access for a variety of devices. More recently WLANs are becoming increasingly popular for mobile applications.

Antennas are critical components in wireless devices. WLAN 2.4 GHz operation bandwidth is only about 100 MHz. The throughput of WLANs decreases if the antenna frequency shifts out of the intended operation band. Throughput decrease causes degradation of transmission capacity. Accordingly, it is of interest to find novel solutions for overcoming resonant frequency shift, or detuning, especially for antenna applications in the WLAN 2.4 GHz band. The resonance of monopole type antennas is easily detuned, causing frequency shift out of operation band when connected to a cable length outside of the design specification. It would be beneficial to provide a modified PIFA antenna capable of achieving high compatibility and high efficiency on WLAN 2.4 GHz with different cable lengths.

SUMMARY OF THE INVENTION

In certain embodiments herein, a modified planar inverted F-type antenna (modified PIFA) is provided. The modified PIFA is configured to resist detuning effects when using various lengths of cable via a coupling element being positioned adjacent to the antenna radiating element.

In one embodiment, the modified PIFA has two arm traces. A first trace produces a primary resonance of the antenna. A second trace is a coupling element for providing tunable control of the antenna frequency response. The coupling element produces a capacitive reactance for accommodating different cable lengths.

In an embodiment, the modified PIFA antenna comprises a slot between the feed and ground. The slot between ground and feed points of the antenna provide a slightly increased frequency bandwidth of antenna.

BRIEF DESCRIPTIONS OF THE DRAWINGS

FIG. 1A shows a top view of the proposed antenna assembly.

FIG. 1B shows a side view of the antenna assembly of FIG. 1A.

FIG. 1C shows a bottom view of the antenna assembly of FIG. 1A.

DETAILED DESCRIPTION OF THE PREFERRED EMBODIMENTS

A modified PIFA antenna is described. The modified PIFA antenna is adapted to achieve resonance in the WLAN 2.4 GHz band for use with a variety of WLAN devices. The modified PIFA antenna has a coupling element adjacent to an antenna radiating portion, and slot positioned between the feed and ground. The coupling element can control antenna resonance on WLAN 2.4 GHz. And the slot can slightly increase frequency bandwidth of the antenna.

The modified antenna generally comprises a radiating portion and a coupling element each extending from a planar base. The radiating portion comprises a primary conductor extending from a first end, where the radiating portion is connected to the base, to a second end. A bifurcated conductor element is disposed about half way between the first and second end of the primary conductor, and comprises a first portion extending orthogonal from the primary conductor, and a second portion extending orthogonal from the first portion and parallel to the primary conductor forming a loop therebetween. The radiating portion further comprises a terminal conductor extending orthogonal from the primary conductor at the second end. The coupling element extends parallel to the second portion of the bifurcated conductor. A signal feed solder pad is disposed on a terminal end of the second portion of the bifurcated conductor. A ground solder pad is disposed on the planar base adjacent to the signal feed solder pad such that the signal feed solder pad and ground solder pads are separated by a slot therebetween.

The modified PIFA can be printed on a flexible adhesive backed substrate. Alternatively, the modified PIFA can be etched or plated on a PCB or on a conductive sheet.

The coupling element is provides a capacitive coupling with the bifurcated conductor element, creating a capacitive reactance which effectively reduces detuning caused by changing the cable length coupled to the antenna feed and ground solder pads. In this regard, the antenna is adapted for use with a number of 2.4 GHz devices, each of the devices requiring a distinct cable length extending from a circuit board of the device to the antenna. The antenna is adapted for resonance in the 2.4 GHz band no matter what cable length is used to connect the antenna to the device.

The slot disposed between the ground and feed solder points creates a slightly larger bandwidth of the antenna.

FIGS. 1(A-C) illustrate a modified PIFA antenna assembly in accordance with the embodiments herein, the antenna is shown as being printed on an adhesive-backed substrate to form an antenna assembly; however other embodiments are within the scope of the invention.

Figure 2:
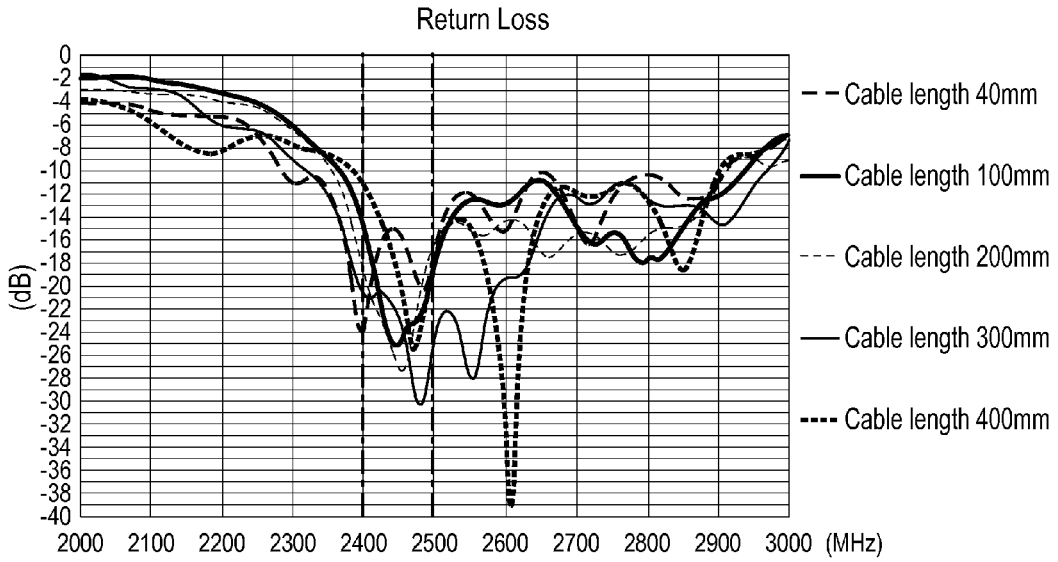
FIG. 2 shows a plot of measured return loss of the antenna of FIG. 1A.

FIG. 2 illustrates return loss of the antenna of FIGS. 1(A-C) using various cable lengths. As can be recognized, the antenna is adapted for use in the 2.4 GHz band using a variety of cable lengths.

Figure 3:
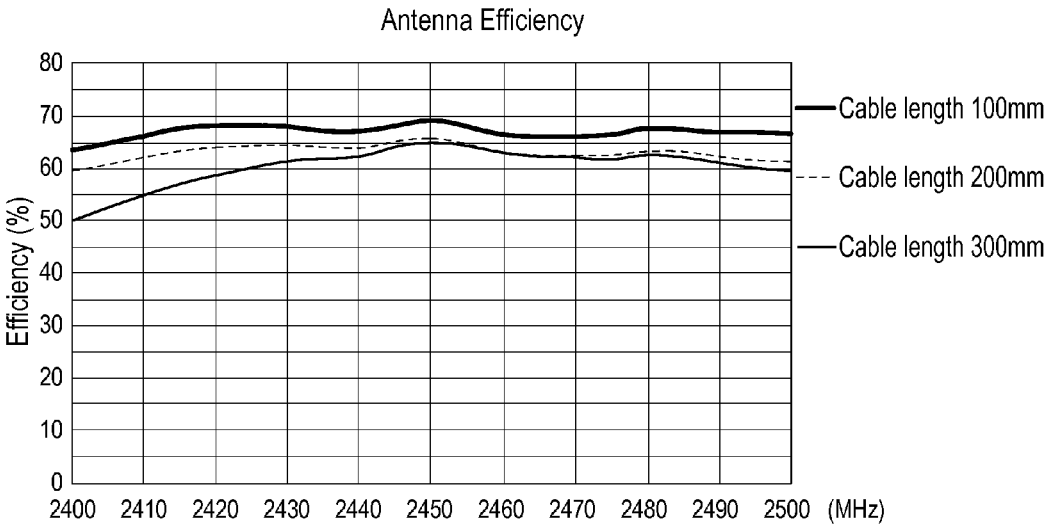
FIG. 3 shows a plot of measured efficiency of the antenna of FIG. 1A.

FIG. 3 illustrates antenna efficiency of the antenna in accordance with FIGS. 1(A-C), using a variety of cable lengths.

Figure 4:
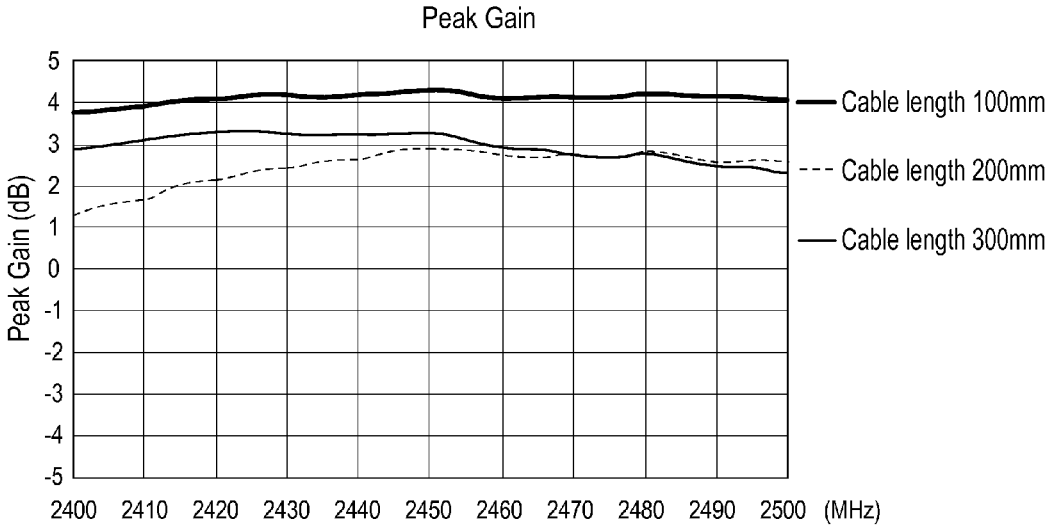
FIG. 4 shows a plot of measured peak gain of the antenna of FIG. 1A.

FIG. 4 illustrates peak gain of the antenna in accordance with the embodiment of FIGS. 1(A-C), using a variety of cable lengths.

Figure 5:
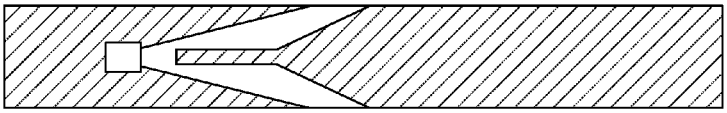
FIG. 5 shows a top view of a monopole antenna.

FIG. 5 illustrates a monopole type antenna for use in the 2.4 GHz band.

Figure 6:
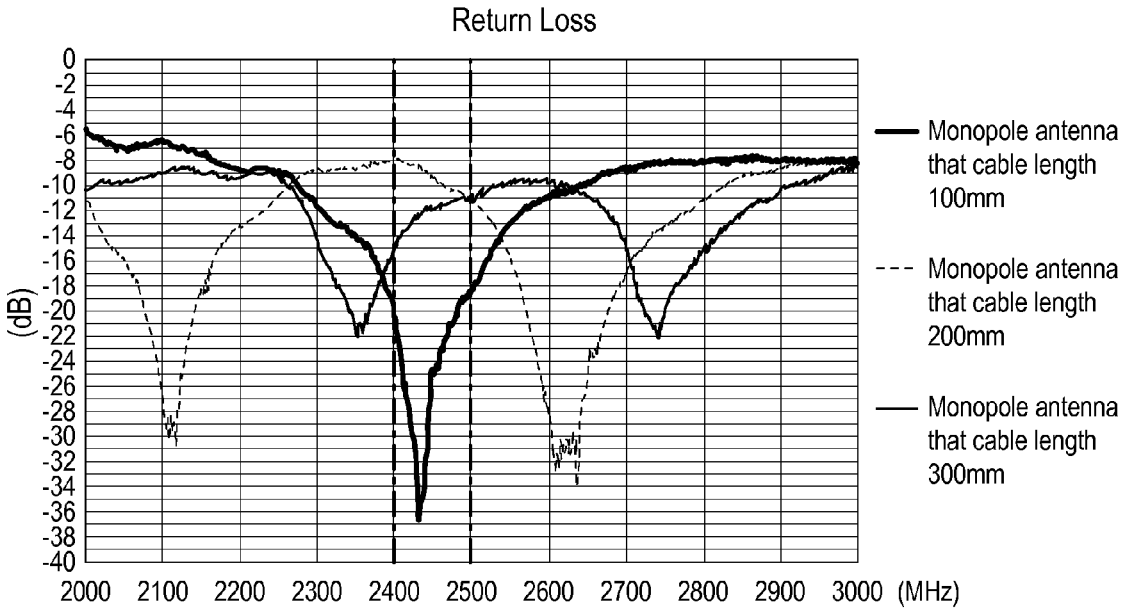
FIG. 6 shows a plot of measured return loss of the monopole antenna of FIG. 5.

FIG. 6 illustrates the return loss of the antenna of FIG. 5 using various cable lengths. As can be recognized, the antenna is subject to detune when using various cable lengths, thus the monopole type antenna must be designed for a specific cable length and is not capable of cross-platform or wide range applications.

We claim:

1. A modified PIFA antenna, comprising:

a planar base;

a radiating portion extending from the planar base, the radiating portion comprising:

a primary conductor element extending from a first end at the base to a second end, a bifurcated conductor element having a first portion extending perpendicularly from the primary conductor at a point about half way between the first and second ends thereof, and a second portion extending perpendicularly from the first portion, the second portion being aligned parallel with the primary conductor element, the first and second portions of the bifurcated conductor element forming a loop with the primary conductor element; and a terminal conductor element extending from the primary conductor element at a second end; and a coupling element extending from the base and being aligned parallel with the second portion of the bifurcated element;

wherein the coupling element is adapted to produce a capacitive reactance for resisting detuning effects caused by connecting the antenna to a cable.

2. The modified PIFA antenna of claim 1, comprising a feed solder pad disposed at a terminal end of the bifurcated conductor element.

3. The modified PIFA antenna of claim 2, comprising a ground solder pad disposed at the base adjacent to the terminal end of the bifurcated conductor element.

4. The modified PIFA antenna of claim 3, wherein said feed solder pad is separated from said ground solder pad by a slot extending therebetween.

5. The modified PIFA antenna of claim 1, wherein said bifurcated conductor element is separated from said primary conductor element by a slot extending therebetween.

6. The modified PIFA antenna of claim 1, wherein said coupling element is separated from said bifurcated conductor element by a slot extending therebetween.

* * * * *